US005429578A

United States Patent [19]

Calbrix et al.

[11] Patent Number: 5,429,578

[45] Date of Patent: Jul. 4, 1995

[54] FOLDING MACHINE FOR AN OFFSET PRINTING PRESS

[75] Inventors: Jean-Claude Calbrix, Rantigny; Gerard Guérinet, Liancourt, both of France

[73] Assignee: Heidelberger Druckmaschien AG, Heidelberg, Germany

[21] Appl. No.: 142,636

[22] Filed: Oct. 25, 1993

[30] Foreign Application Priority Data

Oct. 26, 1992 [FR] France ..... 92 12709

[51] Int. Cl.[6] ..... B65H 45/18; B65H 45/28; B65H 45/16

[52] U.S. Cl. ..... 493/359; 493/429; 493/424; 493/471

[58] Field of Search ..... 493/359, 360, 416, 425, 493/426, 427, 428, 429, 430, 431, 432, 471; 270/4, 6, 10, 19, 21.1

[56] References Cited

U.S. PATENT DOCUMENTS 5,004,451 4/1991 Prüm ..... 493/359

FOREIGN PATENT DOCUMENTS 0086368 5/1986 Japan ..... 270/4
63-185777 8/1988 Japan ..... 493/430
2014114 7/1993 United Kingdom .

*Primary Examiner*—Bruce M. Kisliuk
*Assistant Examiner*—Christopher W. Day
*Attorney, Agent, or Firm*—Kenyon & Kenyon

[57] ABSTRACT

A machine for cutting and folding an uninterrupted printed web of paper to produce folded sections includes a cutting cylinder cooperating with a transfer cylinder. The transfer cylinder is rotationally driven about its longitudinal axis and interacts with a folding cylinder having a set of folding jaws. The transfer cylinder has an external transfer surface interrupted by a number of sets of impaling pins and engaging blades intended to introduce the transversely cut web of paper into the folding jaws. The transfer cylinder also includes means for causing the angular spacing between the engaging blades and the impaling pins to vary. The disclosed transfer cylinder also includes, in the region of its external transfer surface, a set of closure plates on either side of each engaging blade and on either side of each set of impaling pins. The closure plates and the complementary plates may slide with respect to one another, so as to mutually overlap to form a practically continuous external transfer surface, regardless of the angular spacing between the engaging blades and the impaling pins.

12 Claims, 5 Drawing Sheets

FOLDING MACHINE FOR AN OFFSET PRINTING PRESS

FIELD OF THE INVENTION

The present invention relates in general to a folding machine and, in particular, to a folding machine for an offset printing press.

BACKGROUND OF THE INVENTION

Known folding machines cause various folds to occur during a series of successive exchanges between various cylinders whose axes are parallel.

First, the continuous web of paper is generally folded longitudinally by a folding component called a former board. The former board forms a continuous fold in the web running parallel to the two longitudinal edges of the web.

Next, this folded web of paper is cut transversely into copies between a cutting cylinder and a transfer cylinder. For this purpose, the cutting cylinder is equipped with external cutting blades arranged along the generatrices of the cylinder. The transfer cylinder includes a cylinder body provided, on its external surface, with impaling pins and corresponding rubber counterparts arranged along the generatrices of the transfer cylinder.

Thus, each set of impaling pins arranged in series along a generatrix of the transfer cylinder, and which project from the transfer cylinder, takes the web of paper as it runs off; the paper is then immediately cut transversely by means of a cutting blade coupled to the cutting cylinder pressing on the corresponding counterpart of the transfer cylinder.

Each copy thus cut is held by its front edge on the impaling pins projecting from the transfer cylinder. Then the copies receive a first transverse fold between the transfer cylinder and a folding cylinder. A transverse fold will be understood here to mean a fold perpendicular to the longitudinal edges of the copy.

In order to form this first fold, the transfer cylinder also includes, on its external surface, engaging blades arranged along generatrices of the transfer cylinder. The engaging blades are positioned at the external surface of the cylinder with a certain angular offset with respect to the position of the impaling pins. Thus, an engaging blade acts on each copy to be folded so as to introduce this copy into a folding jaw provided on the external surface of the folding cylinder along a generatrix.

It should be emphasized that a transfer cylinder will be understood to mean, on the one hand, a cylinder able to transport, over each set of impaling pins, a single copy so as to introduce it into a folding jaw, the transfer cylinder performing a half revolution between grasping the copy and introducing it into the folding jaw and, on the other hand, a cylinder able to transport, over each set of impaling pins, several copies simultaneously so as to introduce them into a folding jaw, the transfer cylinder then performing several revolutions so as to grasp several copies per set of impaling pins before introducing them into the folding jaw. Such a cylinder is commonly called, by a person skilled in the art, a "collecting transfer cylinder."

More particularly, the engaging blades are securely fastened to plates mounted pivotally on the body of the transfer cylinder. This makes it possible to modify the angular separation between the engaging blades and the impaling pins and hence to modify the position of the first transverse fold with respect to the front and rear edges of the copy.

Indeed, for a particular diameter of the transfer cylinder, in a first configuration, the engaging blades of the transfer cylinder are positioned at an angle of approximately 60° with respect to the impaling pins so as to form a transverse fold in the middle of the length of each copy. In this case, the engaging blade acts in the middle of the copy to be folded, held by its front edge on the impaling pins so as to introduce it into the folding jaw. The impaling pins then retract and the folding cylinder takes the copy folded at its middle towards a square folding device or to a device for forming a second parallel fold.

In a second configuration, the engaging blades of the transfer cylinder are positioned at approximately 40 degrees to the rear with respect to the impaling pins which carry the copy, so as to form a transverse fold in the first third of the length of each copy. In this case, the engaging blade acts on the first third of the copy so as to introduce it into the folding jaw of the folding cylinder.

The mobile mounting of the engaging blades on the transfer cylinder is produced so that each engaging blade, mounted on the pivoting plates, is inserted in a housing provided in the body of the transfer cylinder, this housing being sufficiently wide to allow an angular deflection of the engaging blade at the external surface of the transfer cylinder. Thus, there exists in the majority of cases, a clearance between the engaging blade and the edges of the body of the transfer cylinder, which implies that the external transfer surface of a transfer cylinder may comprise empty spaces which correspond to the deflection clearances existing between the engaging blades and the body of the transfer cylinder. These spaces extend on either side of each engaging blade along the generatrices of the transfer cylinder.

These spaces on the external transfer surface are troublesome because, when a web of paper is flattened onto the transfer surface so as to be cut and folded, the edges of the web of paper may engage in spaces of the transfer surface and copies may then be obtained which are dog-eared or even torn on the edges.

In order to eliminate these spaces on the external transfer surface of the transfer cylinder and to obtain a globally continuous external surface, one known solution is to position a planar comb-shaped component on either side of each engaging blade, which component extends along a generatrix of the transfer cylinder and which is securely fastened to the respective engaging blade. The branches of each comb are inserted into opposite housings provided on the body of the cylinder which housings, in this place, also have the complementary shape of a comb. Thus, when the engaging blades are displaced angularly with respect to the impaling pins, the combs securely fastened to the engaging blades and extending on each side of the latter are at least substantially engaged in the combs securely fastened to the body of the cylinder in the region of the edges adjacent to the engaging blades.

This system of surface combs engaged in one another as a function of the angular separation between the engaging blades and the impaling pins is not satisfactory because the longitudinal edges of the web of paper can still pass, in an untoward fashion, into the free housings left between two successive branches of a comb and produce copies which are dog-eared or which have torn edges.

SUMMARY OF THE INVENTION

In order to overcome the drawbacks of the prior art, the present invention provides a folding machine, which includes a transfer cylinder including a cylinder body having an external surface, a plurality of impaling pins interrupting the external surface of the transfer cylinder, a plurality of engaging blades and a means for causing an angular spacing between the engaging blades and the impaling pins to vary. The transfer cylinder also includes one or more pairs of closure plates disposed adjacent to the external transfer surface. Each pair of closure plates has a first closure plate and a second closure plate. Each first closure plate is disposed adjacent to a first side of an engaging blade corresponding to the pair of closure plates. Each second closure plate is disposed adjacent to a second side of the corresponding engaging blade. The transfer cylinder further includes one or more pairs of complementary plates disposed adjacent to the external transfer surface, each pair of complementary plates having a first complementary plate and a second complementary plate. Each first complementary plate is disposed on a first side of a set of impaling pins corresponding to the pair of complementary plates, while each second complementary plate is disposed on a second side of the corresponding set of impaling pins. Each complementary plate is slidably coupled to a corresponding closure plate to form a substantially continuous external transfer surface independent of the angular spacing between the engaging blade and the set of impaling pins.

A cutting device also cooperates the transfer cylinder, as does a folding device having one or more folding jaws into which the web of paper is introduced by the engaging blades.

Thus, according to the present invention, between each engaging blade and each set of impaling pins there is obtained an external transfer surface which is practically continuous. More particularly, continuity on the edges of the transfer cylinder is maintained by mutual overlapping of the closure plates and the complementary plates. For this reason, when the web of paper is flattened onto this continuous transfer surface, there is no risk of the longitudinal edges of the latter becoming dog-eared or tearing.

Other objects, characteristics and advantages will become apparent in view of the detailed description and accompanying diagrams that follow.

DETAILED DESCRIPTION OF THE INVENTION

Figure 1:
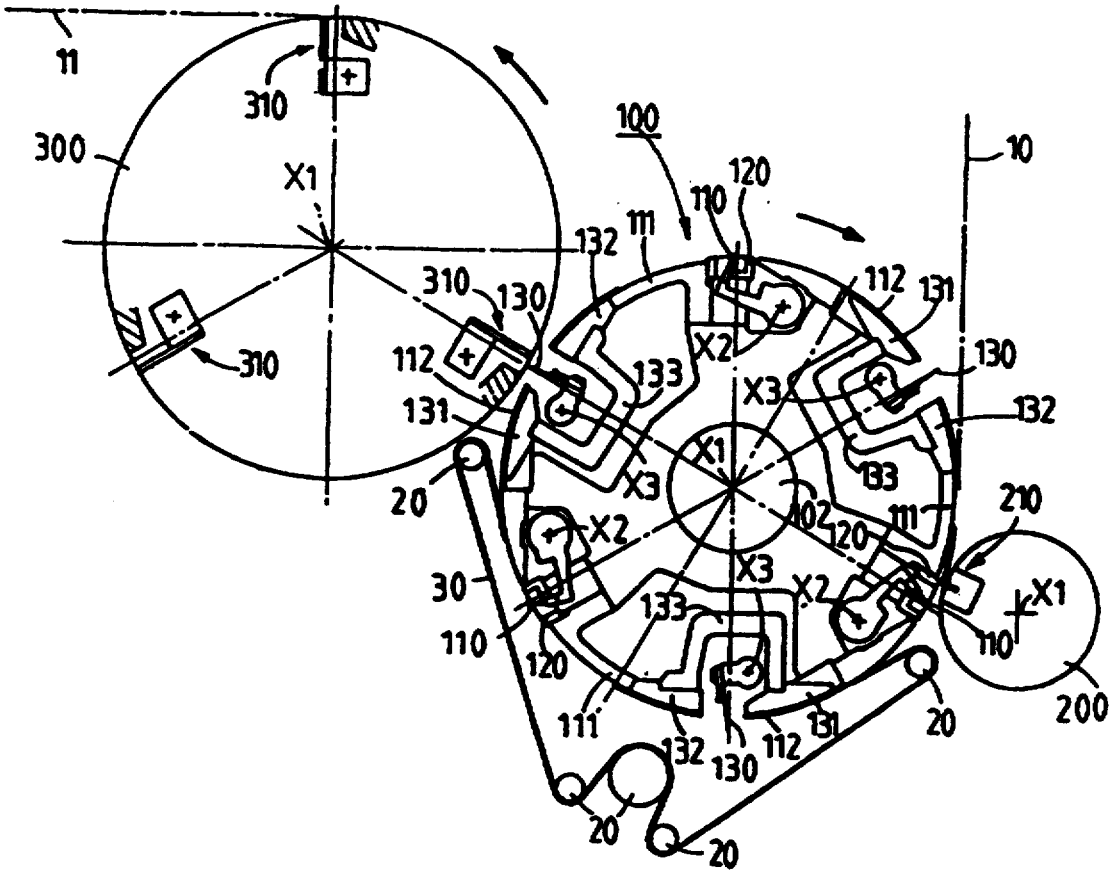
FIG. 1 is a diagrammatic side view in transverse vertical section of part of a cutting and folding machine according to the present invention.

FIG. 1 represents a machine for cutting and folding a printed web of paper 10 in order to form signatures. This machine comprises three cylinders of revolution 100, 200, 300 of parallel longitudinal axes $X_1$ and, more particularly, a cutting cylinder 200, a transfer cylinder 100 and a folding cylinder 300.

The cutting cylinder 200 is positioned substantially beneath the transfer cylinder 100, and the folding cylinder 300 is placed substantially above the transfer cylinder 100. Furthermore, the cutting cylinder 200, rotationally driven about its longitudinal axis $X_1$, has, projecting over its external surface, a cutting blade 210, which extends along a generatrix of the cutting cylinder 200.

The folding cylinder 300, also rotationally driven about its axis $X_1$ in the same direction as the cutting cylinder, has, on its external surface, folding jaws 310, which extend along the generatrices of the cylinder. In particular, this folding cylinder 300 comprises three jaws 310, each of which includes a fixed part and a mobile part and which are offset in pairs by an angle of 120° at the surface of the folding cylinder 300.

The transfer cylinder 100, rotationally driven in the direction opposite to that of the cutting cylinder 200, more particularly includes a cylinder body 101, which is rotationally mounted on a drive shaft 102 about its longitudinal axis $X_1$. This cylinder body 101 carries, in the region of its external surface, also called the transfer surface, impaling pins 110 associated with counterparts of rubber 120.

More particularly, as is better shown in FIGS. 2-5, the transfer cylinder 100 has three sets of impaling pins 110 arranged on its surface, respectively along three generatrices of the transfer cylinder 100 and offset from one another by an angle of 120°. In this example, each set of impaling pins comprises twelve impaling pins 110 mounted in pairs on a series of parallel levers 113 positioned beneath the external surface of the transfer cylinder 100 and mounted pivotally on a drive shaft 114 of axis $X_2$ parallel to the corresponding generatrix of the transfer cylinder and securely fastened to the cylinder body 101. In this manner, by means of the drive shaft 114, the impaling pins 110 may occupy two positions, an extended position, in which they project from the external surface of the transfer cylinder 100, and a withdrawn position, in which the impaling pins 110 are retracted from the external surface, into a housing provided in the body 101 of the cylinder. Furthermore, a counterpart of rubber 120, which extends over a generatrix of the transfer cylinder 100, is associated with each set of impaling pins 110.

Moreover, the transfer cylinder 100 comprises engaging blades 130 distributed over its external transfer surface, each of the engaging blades 130 extends along a generatrix of the cylinder. In particular, this transfer cylinder 100 includes three engaging blades 130, which are positioned on its external surface, each between two successive sets of impaling pins 110. Each engaging blade 130 is placed in a housing provided in the cylinder body 101 along the corresponding generatrix, and is mounted on a shaft 134. Each shaft 134 is mounted in this housing, and is able to pivot about its longitudinal axis $X_3$ so that each engaging blade 130 can also occupy two positions: an extended position in which the engaging blade projects from the external surface of the transfer cylinder, and a withdrawn position in which the engaging blade is retracted inside its housing from the external surface.

Furthermore, the set of engaging blades 130 mounted on their pivoting shaft 134, is securely fastened to two plates, not shown, which are mounted pivotally on each side of the transfer cylinder 100, on the shaft 102, rotationally driving the transfer cylinder 100 about its axis X1. The two pivoting plates are kept securely fastened to one another in rotation by means of three braces 133 of U-shaped cross-section which extend from one side of the transfer cylinder 100 to the other. The braces 133 are placed in the housings of the cylinder body 101 containing the engaging blades 130, and support the engaging blades 130.

Figure 2:
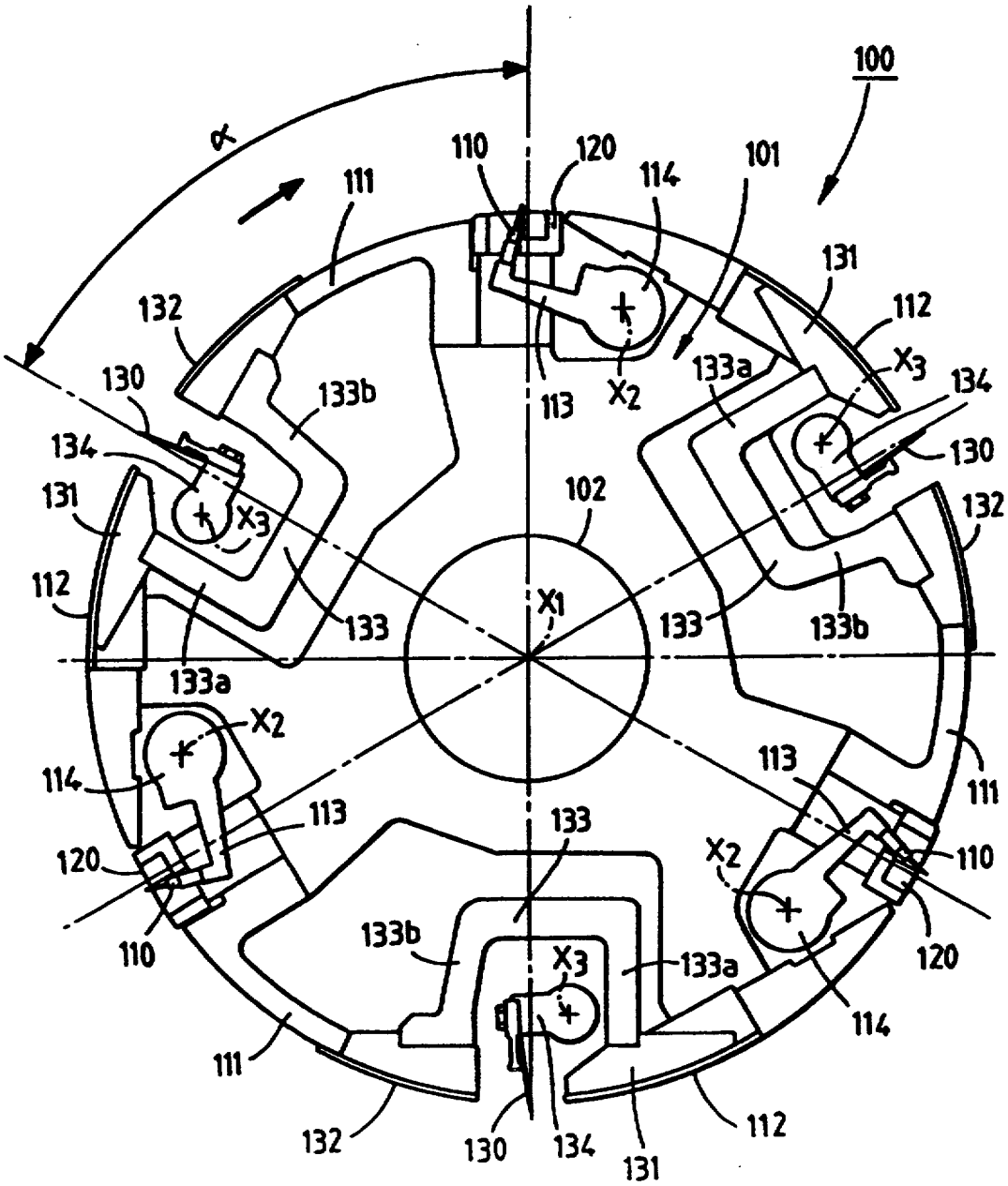
FIG. 2 is a diagrammatic side view in transverse vertical section of the transfer cylinder of the machine of FIG. 1 in the configuration for a first fold with a half-cut.
Figure 3:
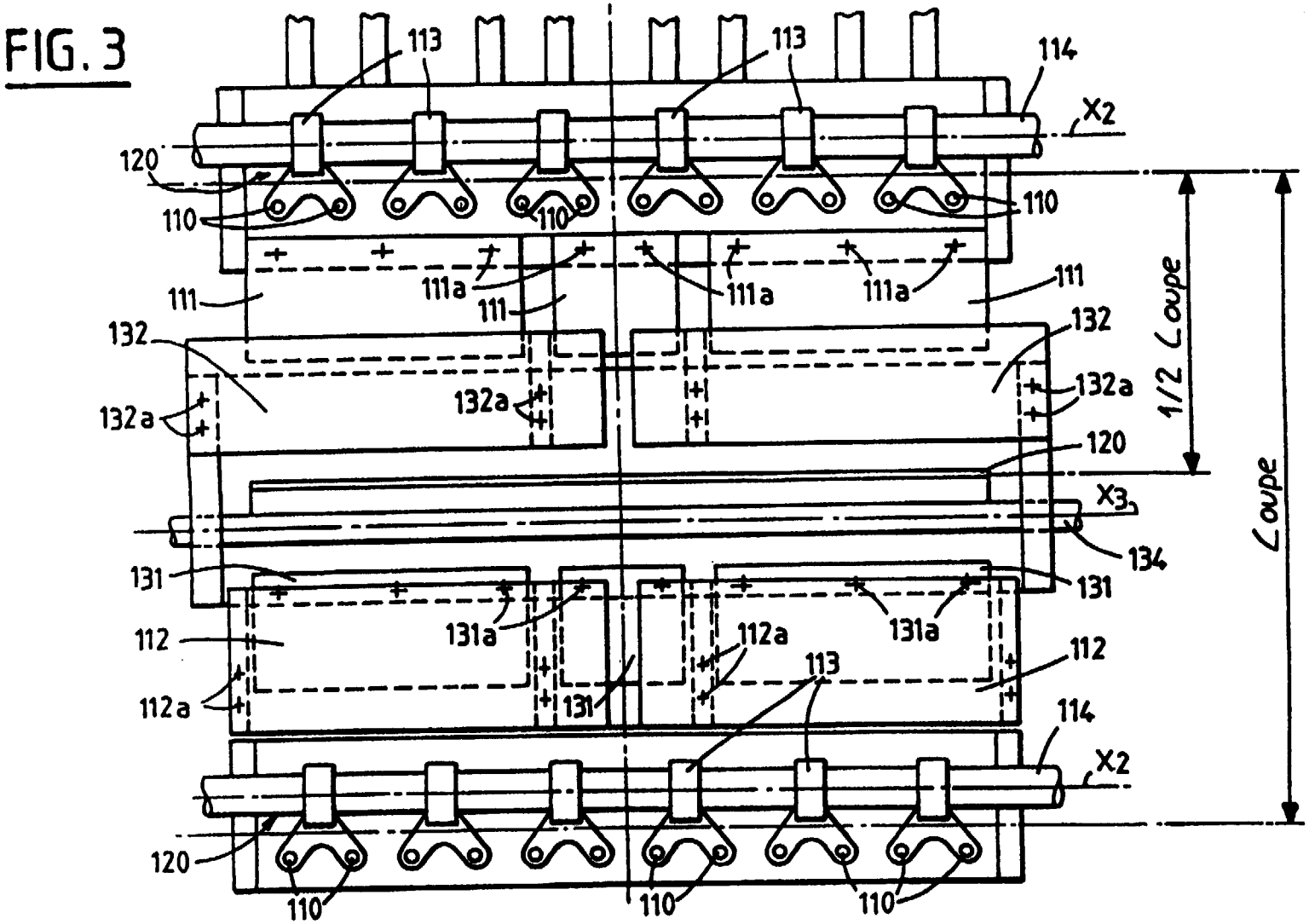
FIG. 3 is a diagrammatic elevational view of part of the external surface of the transfer cylinder of FIG. 2.
Figure 4:
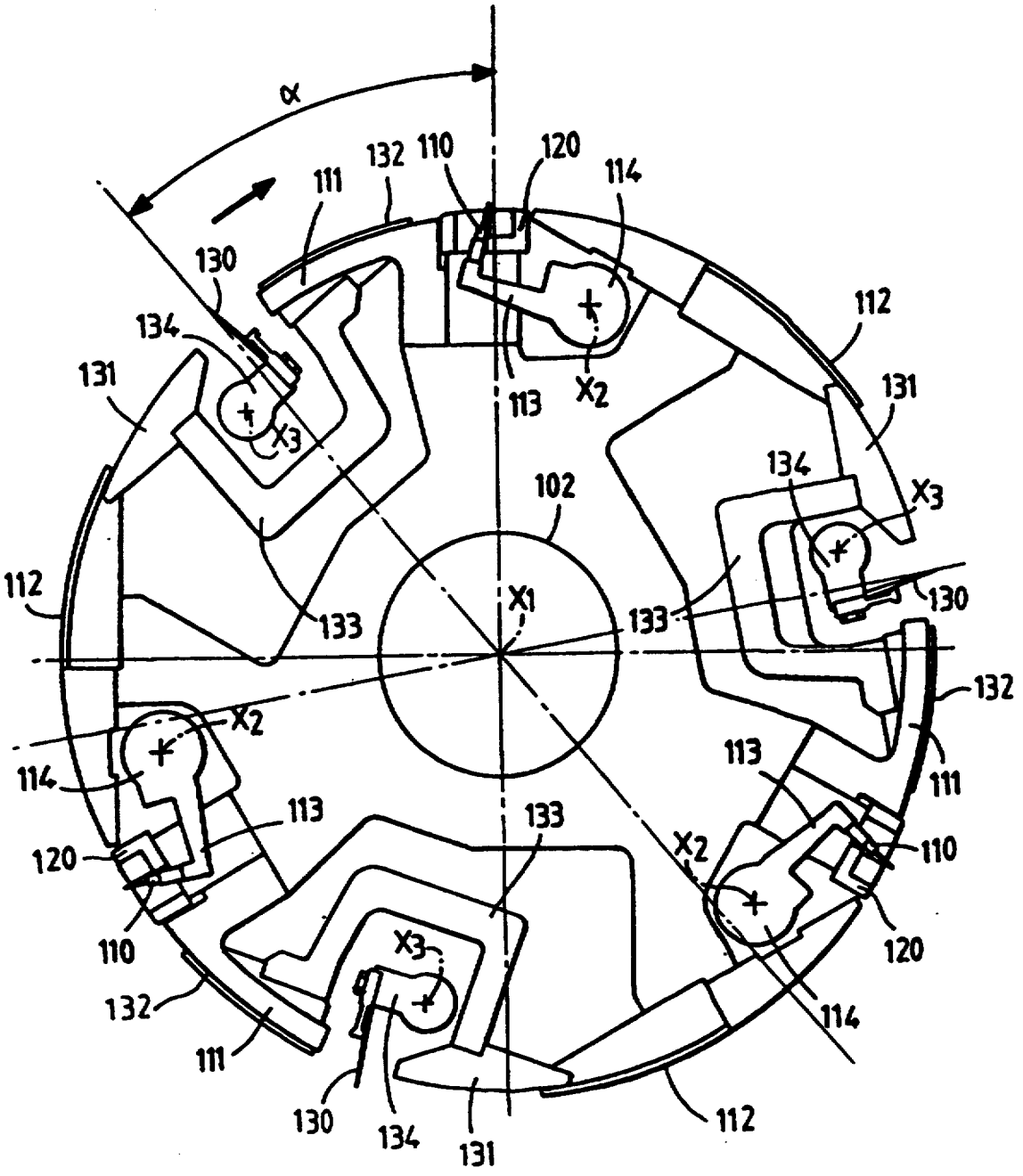
FIG. 4 is a diagrammatic elevational view in transverse vertical section of the transfer cylinder of the machine of FIG. 1 in the configuration for a first fold with a one-third cut.
Figure 5:
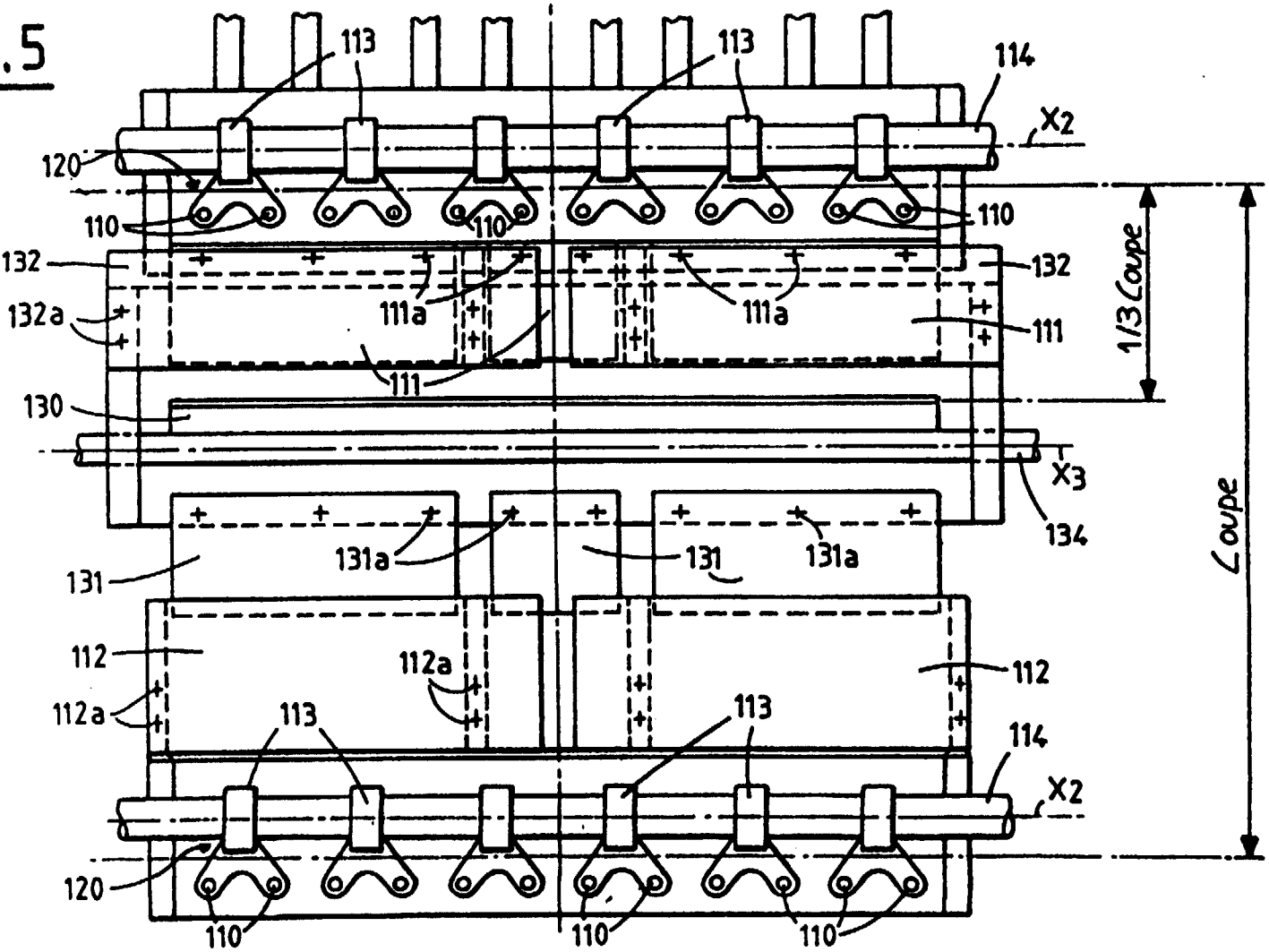
FIG. 5 is a diagrammatic elevational view of part of the external transfer surface of the transfer cylinder of FIG. 4.

Thus, with the aid of the pivoting plates, not shown, the angular separation between the engaging blades 130 and the impaling pins 110 on the external surface of the transfer cylinder can be modified. In particular, FIGS. 2 and 3 represent the transfer cylinder 100 in a first configuration for a fold with a half-cut, according to which the engaging blades 130 are offset by an angle equal to 60° with respect to the impaling pins 110. In contrast, FIGS. 4 and 5 represent the transfer cylinder 100 in a second configuration for a fold with a one-third cut, according to which each engaging blade 130 is offset towards the rear by an angle $\alpha$ of 40° with respect to the set of impaling pins 110 which follows in the direction of rotation of the transfer cylinder 100. It will hence be noted that the housings provided in the cylinder body 101 and containing the engaging blades 130 are sufficiently wide to allow a deflection through 20° of the engaging blades at the surface of the said cylinder.

Moreover, as is better shown in FIGS. 2–5, the braces 133, which carry the engaging blades 130, have parallel vertical branches **133*a*, 133*b* arranged on either side of the engaging blades 130 and along the generatrices of the transfer cylinder 100. Branches 133*a*, 133*b* support closure plates 131, 132. Closure plates 131, 132 are of general rectangular shape and extend, in the region of the external surface of the transfer cylinder, in length along the generatrices of the cylinder, and in width from the branches of the braces 133 towards the cylinder body 101. These closure plates 131, 132** are, for example, made of an aluminum alloy.

The closure plates 131, 132 interact with essentially rectangular complementary plates 111, 112 securely fastened to the cylinder body 101.

Complementary plates 111, 112 are also positioned in the region of the external surface of the transfer cylinder 100 along the generatrices of the transfer cylinder 100 on either side of the set of impaling pins 110, and extend in width from the cylinder body 101 towards the engaging blades 130. In the same way, the complementary plates 111, 112 may consist of an aluminum alloy. Thus, closure plates 131, 132 make it possible to close the empty spaces existing on the external transfer surface of the transfer cylinder 100 between the engaging blades 130 and the cylinder body 101, so as to form a practically continuous external transfer surface regardless of the angular spacing $\alpha$ between the engaging blades 130 and the impaling pins 110.

More particularly, each brace 133 carries a first closure plate 131 on one of its branches **133*a*. Branch 133*a* is situated on the upstream side of the corresponding engaging blade 130, with respect to the direction of rotation of the transfer cylinder 100. The first closure plate 131 may include three essentially rectangular members slightly curved towards the inside of the transfer cylinder 100 and having a radius of curvature equal to that of the external transfer surface, so as to match the shape of the latter. These three disjoint parts are distributed over the entire length of the generatrix of the transfer cylinder 100. Two of the three members have identical dimensions and are positioned such that each of the identical members comprises one of its transverse lateral edges adjacent to one end of the engaging blade. The third member has the same width as the other two, but a shorter length, and is arranged in the region of the middle of the generatrix between the two identical members. Thus, the assembly of the three members constitutes the first closure plate 131, which has two successive transverse discontinuities on either side of the central member in a region neighboring the middle of the generatrix of the transfer cylinder 100. Each member of each first closure plate 131 comprises a longitudinal edge securely fastened to the brace 133, for example by screwing, the longitudinal edge being fastened at two or three fastening points 131*a***.

Furthermore, as can be seen in FIGS. 2–5, each first closure plate 131 is inserted in a sliding fashion under each first complementary plate 112 securely fastened to the cylinder body 101, so as to form a practically continuous external transfer surface between each engaging blade 130 and each set of impaling pins 110. Each first complementary plate 112 consists of two essentially rectangular identical disjoint members, slightly curved towards the inside by having a radius of curvature equal to that of the external transfer surface in the same way as those of the closure plate 131. The two members of each first complementary plate 112 are positioned one behind the other along a generatrix of the cylinder so that each first complementary plate 112 has a transverse discontinuity situated in the middle of the generatrix and so that this discontinuity is substantially filled by the closure plate 131, which slides beneath the latter. In the same way, the two central transverse discontinuities of each first closure plate 131 are substantially filled by each first complementary plate 112, which at least substantially covers the closure plate 131.

In the same way, each brace 133 carries a second closure plate 132 on its other branch **133*b*. Branch 133*b* is situated on the downstream side of the corresponding engaging blade 130, with respect to the direction of rotation of the transfer cylinder 100. The second closure plate 132 may include two identical disjoint members which have an essentially rectangular shape, slightly curved towards the inside of the transfer cylinder 100 and having a radius of curvature equal to that of the external transfer surface of the transfer cylinder 100 so as to match the shape of this surface of revolution of the transfer cylinder 100. These two members are arranged one behind the other over the entire length of the generatrix of the transfer cylinder 100 such that each of the identical members comprises one of its transverse lateral edges adjacent to one end of the engaging blade 130. Thus, the assembly of the two members forms the second closure plate 132, which then has a transverse discontinuity situated in the middle of the generatrix of the transfer cylinder 100. Each of the two members of each second closure plate 132 is fastened in the region of its two transverse lateral edges onto the brace 133 at four fastening points 132*a***.

Furthermore, as can be seen in FIGS. 2–5, each second closure plate 132 covers, in a sliding manner, each second complementary plate 111 securely fastened to the cylinder body 101 so as to form a practically continuous external transfer surface between each engaging blade 130 and each set of impaling pins 110. This second complementary plate 111 is identical to the first closure plate 131 in the sense that it comprises three disjoint members having the same shapes as those of the first closure plate 131 and arranged in the same manner as the latter along the generatrix of the cylinder.

Thus, when the configuration of the transfer cylinder 100 is modified by causing the closure plates 131, 132 to pivot with respect to the body 101 of the cylinder to pass, for example, from a configuration for a fold with a half-cut, see FIGS. 2 and 3, to a configuration for a fold with a one-third cut, see FIGS. 4 and 5, and vice versa, the angular spacing between the engaging blades 130 and the impaling pins 110 passes from 60° to 40° and vice versa, and the closure plates 131, 132 attached to each engaging blade slide one under the first complementary plate 112 and the other over the second complementary plate 111, to globally maintain a continuous external transfer surface of the transfer cylinder.

More particularly, in the configuration for a fold with a half cut, each first closure plate 131 is totally covered by each first complementary plate 112, while each second closure plate 132 only very slightly covers each second complementary plate 111, such that the latter is practically totally uncovered. By contrast, in the configuration for a fold with a one-third cut, each first closure plate 131 has slid so as to become free from the first complementary plate 112 and is now practically uncovered. Furthermore, each second closure plate 132 practically totally covers each second complementary plate 111.

Regardless of the configuration of the transfer cylinder 100, its external transfer surface is practically continuous between the engaging blades 130 and the impaling pins 110. The only spaces which may remain are situated at the center of the transfer surface with respect to the two sides of the transfer cylinder 100 because its spaces correspond to the central transverse discontinuities of the closure plates 131, 132 and complementary plates 111, 112. These central spaces are not troublesome because, regardless of the width of the web of paper when the latter is flattened onto the transfer cylinder 100, it always covers the central part of the external transfer surface of the transfer cylinder 100 and thus the edges of the web of paper 10 are held on a continuous external surface.

Referring now to FIGS. 1–5, an operational mode for the cutting and folding machine is described.

The uninterrupted printed web of paper 10 is brought continuously by means, not shown, to the region of the transfer cylinder 100. Transfer cylinder 100 is rotationally driven such that each set of impaling pins 110 in the extended position is successively inserted in the running web of paper 10 over the entire width of the latter. The web of paper 10 taken away by the transfer cylinder 100 is immediately introduced between the latter and the cutting cylinder 200, rotationally driven in an opposite direction. The cutting blade 210 of the cutting cylinder 200 then cuts the printed web of paper 10 transversely by pressing successively on the rubber counterparts 120 of the rotating transfer cylinder 100 so as to form cut copies, each having a length equal to the length of the circular arc separating two successive sets of impaling pins 110. Each copy, thus cut, is held by its front edge on a set of impaling pins 110 and is flattened onto the external transfer surface of the transfer cylinder 100 by means of an endless belt 30 wound around pulleys 20.

When the machine is in the configuration for a fold with a half cut, as represented in FIGS. 2 and 3, each engaging blade 130 is positioned in the middle of the angular sector separating two successive set of impaling pins 110 and has an angular offset of 60° at the surface with respect to each set of impaling pins 110.

Thus, each copy transported by the transfer cylinder 100 is introduced between the latter and the folding cylinder 300 so as to receive a first transverse fold. Each engaging blade 130 then acts in the middle of the length of each copy so as to introduce it into an open jaw 310 of the folding cylinder 300. Each jaw 310, having received a copy, closes immediately so as to form the first transverse fold in the middle of the copy. Simultaneously, the corresponding impaling pins 110 transporting this copy retract into the withdrawn position, so as to release the folded copy 11. Folded copy 11 is then transported by its middle by the folding cylinder 300 towards a square folding device or a cylinder for forming a second parallel fold (not shown).

When the machine is in the configuration for a fold with a one-third cut, as represented in FIGS. 4 and 5, each engaging blade 130 has a rearward angular offset of 40° with respect to each set of impaling pins 110 which carries each copy by its front edge.

Thus, each copy held by its front edge on the impaling pins 110 is introduced between the transfer and folding cylinders, 100 and 300, respectively, rotating in opposite directions. Each engaging blade 130 acts upon the first third of the length of each copy with respect to its front edge, so as to introduce it into the folding jaw 310 of the cylinder 300. After having received a copy, each jaw 310 closes so as to form a first transverse fold at a third of the cutting length of each copy. Likewise, the impaling pins 110 retract simultaneously upon the closure of each jaw 310, so as to allow the folding cylinder to transport the folded copies 11 towards other devices, not shown.

It should be emphasized that, according to this operational mode, the transfer cylinder 100 performs a half revolution between grasping each copy and introducing it into a folding jaw of 310 the folding cylinder 300.

According to a variant of this operational mode, it may be envisaged that, upon each revolution, each set of impaling pins 110 of the transfer cylinder takes up a copy to be folded, but that this copy is not necessarily introduced immediately into a jaw 310 of the folding cylinder 300. Indeed, in this case, the folding cylinder 300 operates only during one revolution out of two, which means that, during the first revolution, the impaling pins 110 take a first copy; then the transfer cylinder 100 performs a complete revolution so that the impaling pins 110 then take a second copy, the two copies on each set of impaling pins 110 then being introduced simultaneously into a folding jaw 310. In the same manner, the engaging blades 130, according to their position with respect to the set of impaling pins 110, act in the middle or on the first third of the length of the two copies carried by each set of impaling pins 110. Of course, it may also be envisaged for the folding cylinder 100 to act only during one revolution in three and so on, each set of impaling pins 110 of the transfer cylinder 100 then carrying two, three, or even four copies simultaneously before introducing them into the folding jaws 310 of the folding cylinder 300.

It should be emphasized that in the case in which the transfer cylinder 100 is used in such a fashion that each set of impaling pins 110 carries several copies before introducing them into the folding jaws 310 of the folding cylinder 300, this transfer cylinder 100 is more particularly called a "collecting transfer cylinder".

The invention is not limited to the embodiment described and represented, but a person skilled in the art will know how to add thereto any variant in accordance with its spirit.

What is claimed is:

1. An apparatus for cutting and folding a web of material, comprising:

a) a transfer cylinder including:

a cylinder body having an external surface;

a plurality of sets of impaling pins, each set of impaling pins selectively movable between a retracted and an extended position relative to the external surface;

a plurality of engaging blades pivotably coupled to the cylinder body;

a mechanism for varying an angular spacing between the engaging blades and the sets of impaling pins, the mechanism coupled to the cylinder body;

one or more pairs of closure plates disposed adjacent to the external surface, each pair of closure plates comprising a first closure plate and a second closure plate, each first closure plate disposed adjacent to a first side of an engaging blade corresponding to the pair of closure plates, and each second closure plate disposed adjacent to a second side of the corresponding engaging blade;

one or more pairs of complementary plates disposed adjacent to the external surface, each pair of complementary plates having a first complementary plate and a second complementary plate, each pair of complimentary plates associated with a respective set of impaling pins, each first complementary plate of a pair of complementary plates disposed on a first side of the respective set of impaling pins, and each second complementary plate of the pair of complimentary plates disposed on a second side of the respective set of impaling pins, each complementary plate slidably coupled to a corresponding closure plate to form a substantially continuous external transfer surface independent of the angular spacing between the engaging blade and the set of impaling pins;

b) a cutting cylinder cooperating with the transfer cylinder; and c) a folding cylinder cooperating with the transfer cylinder having one or more folding jaws into which the web of paper is introduced by the engaging blades.

2. The apparatus according to claim 1, further comprising a support for mounting each engaging blade pivotably with respect to the transfer cylinder, wherein:

a first closure plate is disposed on the first side of each engaging blade and along a first generatrix of the transfer cylinder parallel to the engaging blade, each first closure plate having three generally rectangular disjoint elements distributed along the first generatrix and secured to the support;

a second closure plate is disposed on the second side of each engaging blade and along a second generatrix of the transfer cylinder parallel to the engaging blade, each second closure plate having two generally rectangular disjoint elements distributed along the second generatrix and secured to the support; and the complementary plates are secured to the transfer cylinder along additional generatrices of the transfer cylinder.

3. The apparatus according to claims 1 or 2, wherein the closure plates and the complementary plates have curvature about the transfer cylinder and a radius of curvature substantially equal to a radius of curvature of the external surface of the transfer cylinder.

4. An apparatus according to claims 1, 2 or 3, wherein each first closure plate, depending on the angular spacing between the engaging blades and the set of impaling pins, is at least substantially covered by a complementary plate, and each second closure plate at least substantially covers another complementary plate.

5. An apparatus according to claim 4, wherein each complementary plate partially covering a first closure plate has two generally rectangular disjoint elements distributed over a corresponding generatrix of the transfer cylinder, and each complementary plate partially covered by a second closure plate has three generally rectangular disjoint elements distributed over a corresponding generatrix of the transfer cylinder.

6. An apparatus according to any one of claims 1 to 5, wherein the closure plates and the complementary plates are composed of an aluminum alloy.

7. A transfer cylinder comprising:

a cylinder body having an external surface;

a plurality of sets of impaling pins, each set of impaling pins selectively movable between a retracted and an extended position relative to the external surface;

a plurality of engaging blades pivotably coupled to the cylinder body;

a mechanism for varying an angular spacing between the engaging blades and the sets of impaling pins, the mechanism coupled to the cylinder body;

one or more pairs of closure plates disposed adjacent to the external transfer surface, each pair of closure plates comprising a first closure plate and a second closure plate, each first closure plate disposed adjacent to a first side of an engaging blade corresponding to the pair of closure plates, and each second closure plate disposed adjacent to a second side of the corresponding engaging blade; and one or more pairs of complementary plates disposed adjacent to the external surface, each pair of complementary plates having a first complementary plate and a second complementary plate,each pair of complimentary plates associated with a respective set of impaling pins, each first complementary plate disposed on a first side of the respective set of impaling pins, and each second complementary plate of the pair of complementary plates disposed on a second side of the respective set of impaling pins, each complementary plate slidably coupled to a corresponding closure plate to form a substantially continuous external transfer surface independent of the angular spacing between the engaging blade and the set of impaling pins.

8. The transfer cylinder according to claim 7, further comprising a support for mounting each engaging blade pivotably with respect to the transfer cylinder, wherein:

a first closure plate is disposed on the first side of each engaging blade and along a first generatrix of the transfer cylinder parallel to the engaging blade, each first closure plate having three generally rectangular disjoint elements distributed along the first generatrix and secured to the support;

a second closure plate is disposed on the second side of each engaging blade and along a second generatrix of the transfer cylinder parallel to the engaging blade, each second closure plate having two generally rectangular disjoint elements distributed along the second generatrix and secured to the support; and the complementary plates are secured to the transfer cylinder along additional generatrices of the transfer cylinder.

9. A transfer cylinder according to claims 7 or 8, wherein the closure plates and the complementary plates have curvature about the transfer cylinder and a radius of curvature substantially equal to a radius of curvature of the external surface of the transfer cylinder.

10. A transfer cylinder according to claims 7, 8 or 9, wherein each first closure plate, depending on the angular spacing between the engaging blades and the set of impaling pins, at least substantially covered by a complementary plate, and each second closure plate at least substantially covers another complementary plate.

11. A transfer cylinder according to claim 10, wherein each complementary plate partially covering a first closure plate has two generally rectangular disjoint elements distributed over a corresponding generatrix of the transfer cylinder, and each complementary plate partially covered by a second closure plate has three generally rectangular disjoint elements distributed over a corresponding generatrix of the transfer cylinder.

12. A transfer cylinder according to any one of claims 7 to 11, wherein the closure plates and the complementary plates are composed of an aluminum alloy.

* * * * *